US009145285B1

(12) United States Patent
Finfrock et al.

(10) Patent No.: US 9,145,285 B1
(45) Date of Patent: Sep. 29, 2015

(54) PANEL LIFTING APPARATUS AND PROCESS

(71) Applicants: Robert D Finfrock, Orlando, FL (US); Allen R Finfrock, Winter Park, FL (US)

(72) Inventors: Robert D Finfrock, Orlando, FL (US); Allen R Finfrock, Winter Park, FL (US)

(73) Assignee: Finfrock Industries, Inc., Apopka, FL (US)

( * ) Notice: Subject to any disclaimer, the term of this patent is extended or adjusted under 35 U.S.C. 154(b) by 0 days.

(21) Appl. No.: 14/592,570

(22) Filed: Jan. 8, 2015

(51) Int. Cl.
*B66F 9/00* (2006.01)
*B66F 11/00* (2006.01)
*B66F 19/00* (2006.01)

(52) U.S. Cl.
CPC ..... *B66F 9/00* (2013.01)

(58) Field of Classification Search
CPC ..... B66D 1/28; B66F 9/02; B66F 11/04; B66F 19/00; E04F 21/18
See application file for complete search history.

(56) References Cited

U.S. PATENT DOCUMENTS

| | | | | |
|---|---|---|---|---|
| 3,092,065 | A * | 6/1963 | Kummerman | 114/202 |
| 3,626,889 | A * | 12/1971 | Hover | 114/203 |
| 3,678,985 | A * | 7/1972 | Kummerman | 160/188 |
| 5,368,429 | A * | 11/1994 | Young | 414/11 |
| 5,441,379 | A * | 8/1995 | Gilbert, Jr. | 414/494 |
| 5,460,469 | A * | 10/1995 | Young | 414/11 |
| 5,984,605 | A * | 11/1999 | Young | 414/11 |
| 6,511,275 | B2 * | 1/2003 | Ray | 414/11 |
| 6,773,218 | B1 * | 8/2004 | Mingoes | 414/10 |
| 7,448,598 | B1 * | 11/2008 | Elmlinger et al. | 254/338 |
| 7,891,150 | B2 | 2/2011 | Finfrock et al. | |
| 8,667,755 | B1 | 3/2014 | Finfrock et al. | |
| 8,763,333 | B1 | 7/2014 | Finfrock et al. | |
| 8,875,471 | B2 * | 11/2014 | Siqueiros | 52/745.2 |

FOREIGN PATENT DOCUMENTS

EP 0716041 A1 * 6/1986

* cited by examiner

*Primary Examiner* — Jeanette E Chapman
(74) *Attorney, Agent, or Firm* — William M. Hobby, III

(57) ABSTRACT

This invention relates to the lifting of a concrete panel and especially to a method and apparatus for lifting a concrete panel and to lifting a composite truss having a pair of spaced apart prestressed concrete panels.

9 Claims, 4 Drawing Sheets

PANEL LIFTING APPARATUS AND PROCESS

FIELD OF THE INVENTION

This invention relates to the lifting of a concrete panel and especially to a method and apparatus for lifting a concrete panel and to lifting a composite truss having a pair of spaced apart prestressed concrete panels.

BACKGROUND OF THE INVENTION

Prefabricated double wall concrete components have been used in the past to construct building walls. Such wall members may include a plurality of welded wire spacing frames to retain the slabs of the wall member in a spaced apart configuration. Typically, the welded wire spacing frames provide limited structural reinforcement of the wall member. It has been proposed to use such prefabricated wall members as structural flooring and/or roofing members. However, a dual slab member designed as a wall may not be readily adaptable to a floor or roofing application due to different loading forces on the member. For example, a wall member used in a floor application may have a limited span distance due to the minimum structural capacity provided by the welded wire spacing frames. More robust welded steel trusses having upper and lower longitudinal portions embedded in respective upper and lower slabs have been proposed as a framing structure for a composite truss that can span up to 60 feet and greater. However, the great weight of these large duel panel prefabricated trusses raises problems of lifting and moving the truss without damaging the truss panels. It becomes desirable to incorporate means in a truss during manufacture of the truss for connecting lifting cables or hooks which can support the great weight of the truss. Attaching and/or other structural attachment techniques used to manufacture such framing structures significantly adds to the cost and time needed to manufacture the trusses and thereby increases the cost of the composite truss.

In our prior U.S. Pat. No. 8,667,755 for a Dual Panel Composite Truss Apparatus, a dual panel truss has a pair of spaced apart prestressed concrete panels having a versatile and adaptive structurally supporting end bearing truss on the ends thereof. The end bearing truss incorporates a versatile and adaptive structural support on each end of the composite truss. The end bearing truss is formed as an integral part of the composite truss for supporting the ends of the composite truss when the composite truss is used for the floors and ceiling of a building. The end bearing truss advantageously forms each end of each concrete panel form for the concrete pour when making each concrete panel. This prior patent is an improvement of our prior U.S. Pat. No. 7,891,150 for a Composite Truss by Robert D. Finfrock and Allen R. Finfrock. In this prior patent, a composite truss has a pair of spaced apart prestressed concrete panels and a plurality of substantially vertical members spanning between the pair of spaced apart concrete panels, one end portion of each vertical member being embedded in one of the spaced apart concrete panels and the opposite end being imbedded in the other concrete panel. The truss includes a diagonal member spanning between the one end of a vertical member and the other end of an adjacent vertical member. Each end of the diagonal member non-structurally engages an end of a vertical member. Each diagonal member also has a length thereof embedded in the concrete in each spaced apart concrete panel. Each end of the composite truss has a prefabricated concrete end bearing beam for supporting the end of the composite truss.

Our prior U.S. Pat. No. 8,763,333 is for a method of making a dual panel composite truss having a pair of spaced apart prestressed concrete panels. The process includes assembling the truss frame, which includes interconnecting and mounting a plurality of steel posts and connecting truss members and reinforcing rods, and positioning a truss frame in a panel form having prestressed strands therein for pouring a first prestressed concrete panel on one side of the truss frame. The truss frame with the first concrete panel is then stripped from the form, lifted and placed on a turning table and turned to position the other side of the truss frame in the panel form for pouring concrete into the panel form for pouring the second prestressed concrete panel, which when cured, is spaced from the first panel by the truss frame forming a composite.

In our prior U.S. patent application Ser. No. 14/533,173 for a Truss Lifting Apparatus and Process, a truss lifting system is used for coupling a lifting truss to a load to be lifted and especially for lifting a large prefabricated concrete panel in the making of a dual panel truss having one of a pair of spaced apart concrete panels of a composite truss formed. The lifting process in this application has a lifting truss having a plurality of spaced hydraulic cylinders hanging therefrom with each hydraulic cylinder having a lifting hook attached thereto for attaching to an attachment member on an object to be lifted. The plurality of hydraulic cylinders are actuated simultaneously to pull each coupled lifting hook and attachment member taut and then locked for the lifting truss to lift the attached object.

The present invention is for a system for lifting a complete concrete panel and especially a dual concrete panel truss having two spaced prestressed concrete panels which form a composite truss.

SUMMARY OF THE INVENTION

This invention relates to a method and apparatus for lifting a concrete panel and especially a dual panel composite truss having a pair of spaced apart prestressed concrete panels spaced by a plurality of truss frame members for use in building floors and ceilings and the like.

The lifting assembly for lifting the concrete panel has an elongated lifting beam for lifting a generally flat concrete panel having a plurality of grasping members formed thereon. A plurality of lifting cables are attached to the lifting beam for lifting the lifting beam with a crane or winch or the like. A plurality of shackles are attached to the beam and a plurality of lifting slings are attached to the shackles. Each lifting sling has a lifting hook on the end thereof. A plurality of wheel assemblies are fixedly attached to the lifting beam, and each wheel assembly has a beam tilting cam thereon. The lifting assembly can be rolled on a surface of a generally flat concrete panel to position the sling hoisting hooks for connection to the grasping members and the lifting assembly and concrete panel lifted. The beam assembly may be an I-beam made up of two C-beams and may have a storage rod attached thereto for attaching the sling hoisting hooks for storing the slings.

A concrete panel to be lifted by the lifting assembly may be a composite truss having a plurality of steel truss members at least partially embedded in a pair of spaced concrete panels, each panel having two ends and an elongated angle-iron end plate with at least two intersecting sides. The elongated angle-iron end plate is attached to a plurality of steel truss members. A plurality of grasping members are formed into one or both of the concrete panel ends with each grasping member being shaped to removably receive a hoisting hook therein. Each of the grasping members are fixedly attached to two sides of the end plate and to one of the steel truss members. The dual panel composite truss has a plurality of built-in grasping members in both end portion of one or both concrete panels and positioned for grasping and lifting the panel. The truss frame members can include posts and bent rod truss frame members. The grasping member has an angled surface so one of the bent rod members can be fixedly attached thereto. The grasping member has a generally C-shaped opening fixedly welded to the sides of the end plate for forming a grasping opening.

A process of lifting a generally flat panel includes selecting a generally flat concrete panel having a plurality of steel reinforcing members and having two end portions. The selected concrete panel has an elongated steel end plate thereon having at least two intersecting sides and having a plurality of grasping members each fixedly attached to the two intersecting sides of the end plate. Each grasping member is also attached to at least one of the reinforcing members and shaped to removably receive a lifting hook therein. The process also includes electing a lifting assembly having an elongated lifting beam for lifting a generally flat concrete panel. The lifting beam has a plurality of lifting cables attached thereto for lifting the lifting beam. A plurality of shackles are attached to the lifting beam and has a plurality of lifting slings attached thereto. Each lifting sling has a lifting hook on the end thereof. The selected lifting beam also has a plurality of wheel assemblies attached thereto and a beam tilting cam thereon. The selected lifting assembly is placed on the selected concrete panel and rolled on the concrete panel to position the sling hoisting hooks adjacent the grasping members. Each hoisting hook is attached to a grasping member and the lifting assembly and attached concrete panel are then lifted by a winch or crane. The lifting assembly is thus rolled on the surface of a generally flat concrete panel to position a plurality of sling lifting hooks for connection to the grasping members on a generally flat concrete panel for lifting the concrete panel.

BRIEF DESCRIPTION OF THE DRAWINGS

The accompanying drawings, which are included to provide further understanding of the invention are incorporated in and constitute a part of the specification, and illustrate an embodiment of the invention and together with the description serve to explain the principles of the invention.

In the drawings.

DETAILED DESCRIPTION OF AN EXEMPLARY EMBODIMENT

Figure 1:
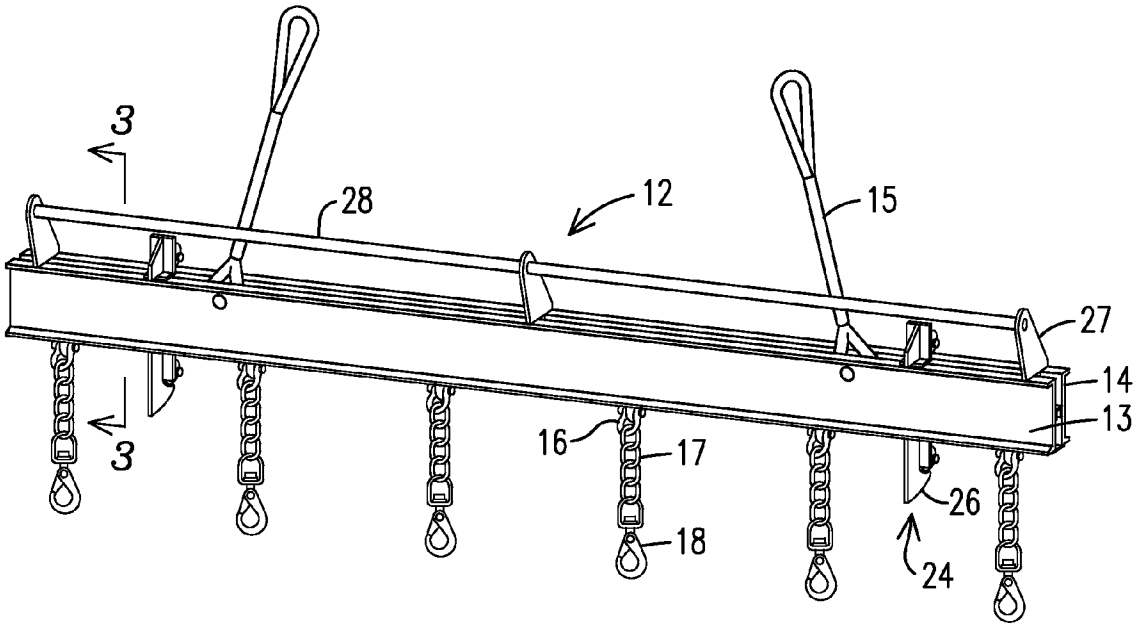
FIG. 1 is a perspective view of a concrete panel lifting assembly in accordance with the present invention.
Figure 2:
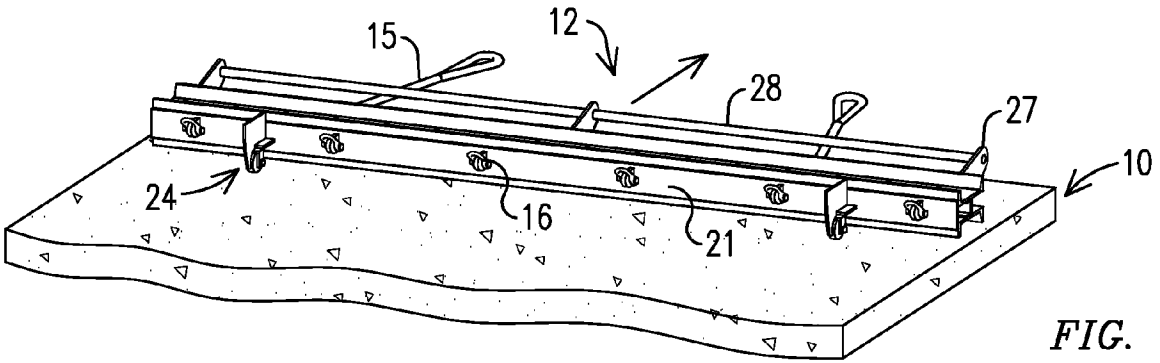
FIG. 2 is a perspective view of a the panel lifting assembly of FIG. 1 on top of a concrete panel to be lifted.
Figure 3:
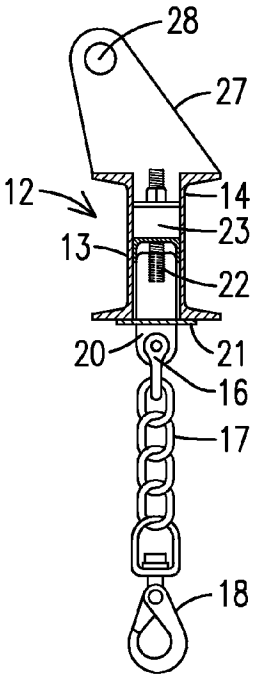
FIG. 3 is a sectional view taken on the line 3-3 of FIG. 1.
Figure 4:
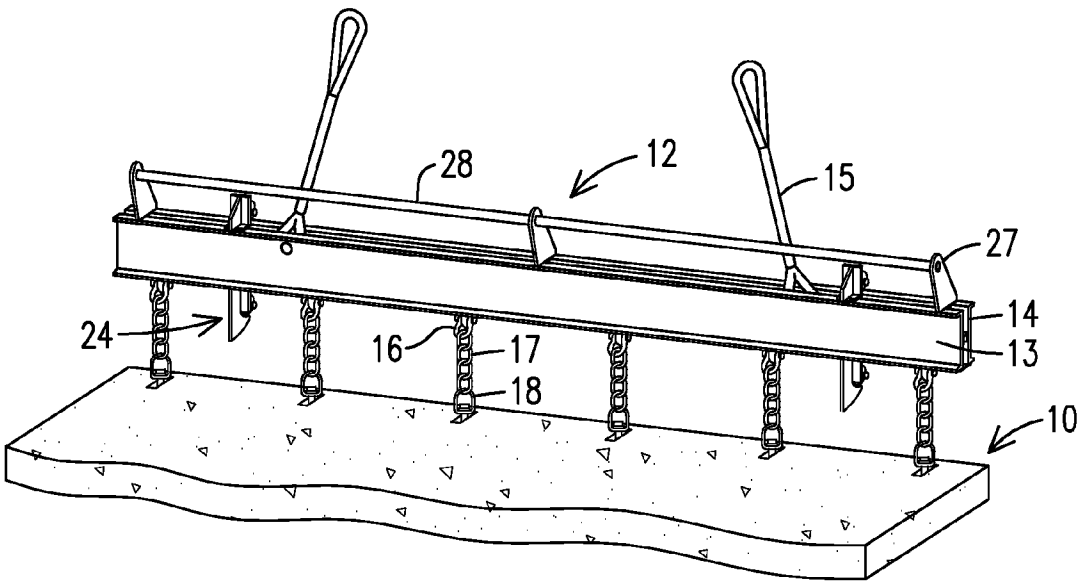
FIG. 4 is a perspective view of the lifting assembly of FIG. 1 lifting a concrete panel.

As seen in the drawings this invention relates to a method and apparatus for lifting a concrete panel 10 having predetermined lifting eye members 11 using a lifting beam 12 which is hoisted with a crane, winch or the like. The beam 10 being lifted may be 60 or more feet in length and weight in excess of 50,000 pounds such as the dual panel prestressed composite truss of our prior patents and application (Id.).

Figure 5:
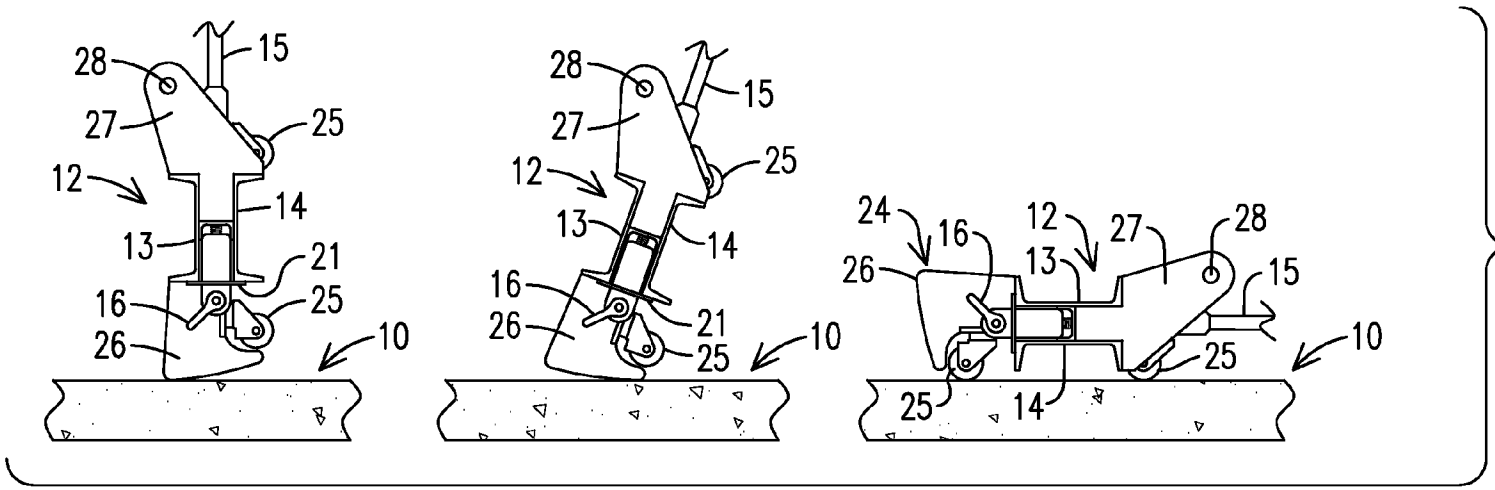
FIG. 5 is a sectional view taken through the lifter assembly of FIG. 1 showing the roller cam in a rolling position and in an upright tilted position.
Figure 6:
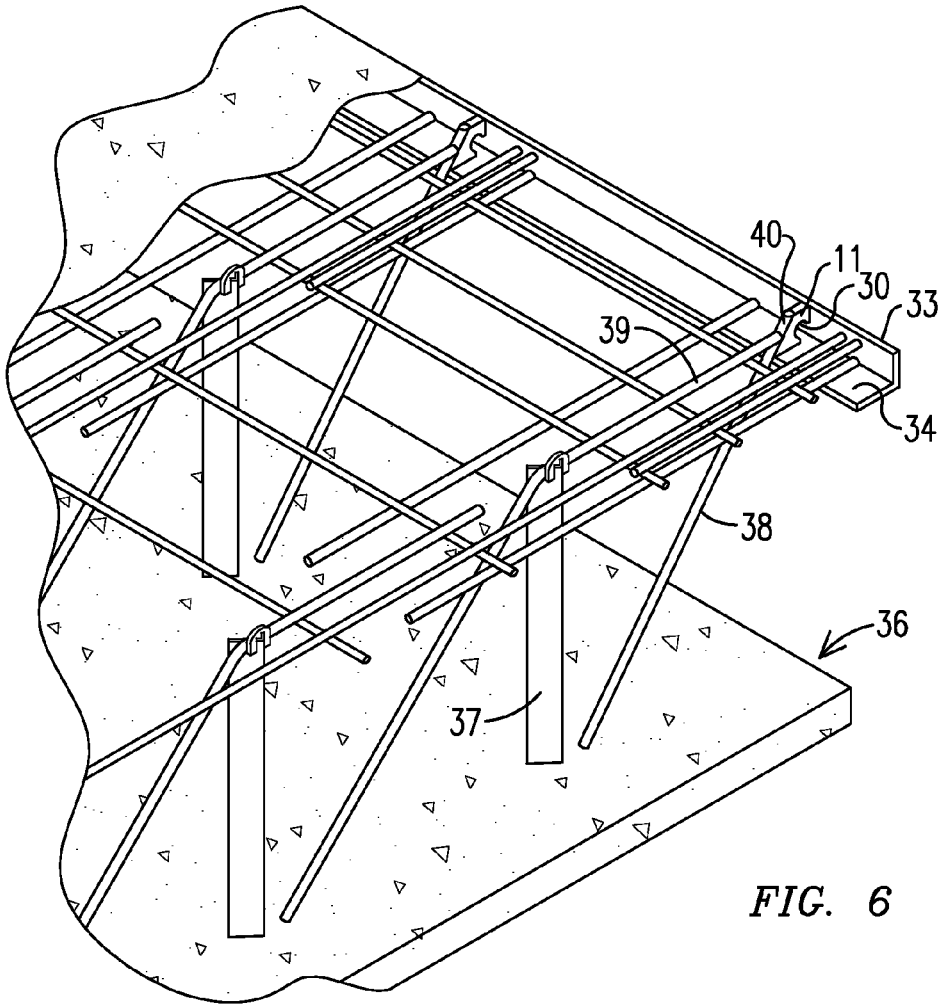
FIG. 6 is a partial cut-away perspective view of a section of a dual panel truss having the lifting members therein.
Figure 7:
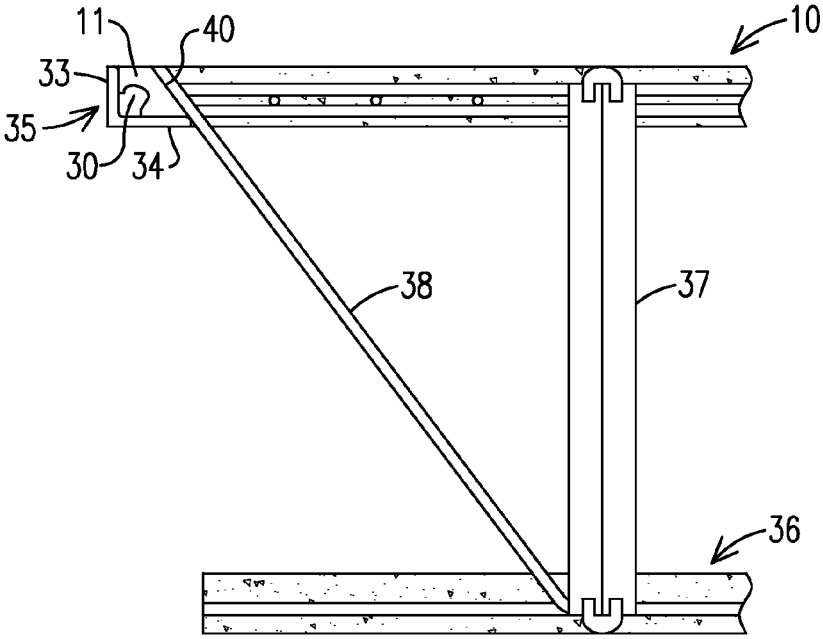
FIG. 7 is a sectional view taken through the end of the dual panel truss of FIG. 6.
Figure 8:
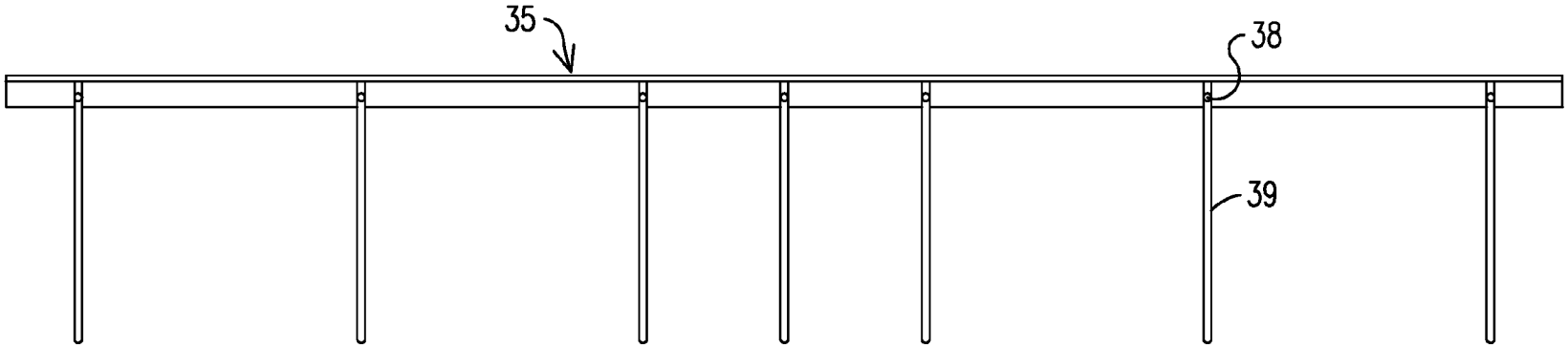
FIG. 8 is a top plan view of the end plate with attached lifting members from the dual panel truss of FIGS. 2 and 7.
Figure 9:
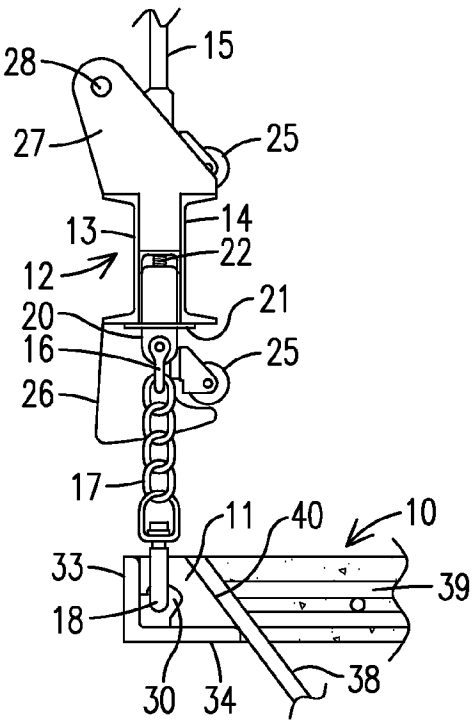
FIG. 9 is a sectional view taken through the lifting assembly of FIG. 1 showing a hoisting hook engaging a grasping member of a concrete panel.

In the drawings, FIGS. 1-5 and 9 the lifting beam 12 is illustrated as an I-beam formed with two C-beams 13 and 14. A pair of lifting cables 15 are attached to the beam 12 for connecting to a winch or the like for lifting the beam 12 and an attached concrete panel. The beam 12 has a plurality of shackles 16 attached thereto each having a sling 17 attached thereto and having a hoisting hook 18 on the end thereof for grasping a lifting eye 11 as more clearly seen if FIG. 9. Each shackle 16 is connected between the C-beams 13 and 14 as in FIG. 3 with a shackle holding member 20 which slides in a slotted guide plate guide 21 and connects with a bolt through an elastomer pad 23. This gives the shackle a small amount of play when lifting with a plurality of slings 17 in lifting large loads. The beam 12 also has a pair of roller cam assemblies 24 as best seen in FIG. 5. The assemblies 24 each have two rollers 25. The assemblies also each have a tilting cam 26 on the end thereof. The roller cam assemblies 24 allow the lifting beam 12 to be rolled on the surface of a flat panel to align the slings 17 for connecting the hoisting hooks 18 to be connected to the lifting eyes 11 as seen in FIG. 9 at which time the beam 12 can be tilted on the cams 26 to an upright position for lifting the beam 12 and panel 10. The beam 12 also has a pair of rod holding flanges 27 extending from the opposite side of the beam 12 from the slings 16 which flanges hold a sling hook rod 28 extending therebetween. Rod 28 is positioned for the slings 17 hoisting hooks 18 to be hooked thereto to hold the slings 17 out of the way while rolling the beam 12 into position. The beam 12 may weigh 600 pounds and thus the need for the roller and cam assembly and sling storage rack.

In operation, the beam 12 can be lifted by a winch and positioned on one end of a concrete panel 10 and rolled on rollers 25 to position and attach the slings 17 to the panel 10 lifting eyes 11. The beam 12 can then be tilted on cams 26 hoisted by a winch to lift one end of the panel 10. The buffering of each sling 17 with the elastomer pad 23 takes up for minor variations in the slings 17 lifting the panel 10. It will be clear that there is a lifting beam 12 connected to each end of the panel 10 for lifting the panel.

As more clearly seen in FIGS. 6, 7, 8 and 9, the panel 10 has built thereinto a plurality of lifting members 11 which can be grasped by a sling 17 hoisting hook 18. The lifting member 11 has a generally C-shaped opening 30 with two flat sides shaped to fit against one side of a steel angle iron member 35 which angle iron member is one end plate of a panel 10. In the present application the end angle iron plate is formed into one panel of a dual panel composite trust as better seen in FIG. 6 which truss has two panels 10 and 36 spaced by a plurality of steel truss members including posts 37 and a plurality of steel bent rod members 38 as has been set forth in more detail in our prior patents. The bent rod members 38 on the end of the truss are angled to fit onto an angled side 40 of the lifting member 11. The bent member 38 is welded to the lifting member 11 and the lifting member 11 flat sides are welded to the angle iron flat sides 33 and 34. Concrete panel reinforcing member 39 can be seen having its end welded to bent member 38 to provide greater strength to the lifting member 11. This provides the opening in the lifting member 11 for the hoisting hook 18. This combination of attachments of the lifting member 11 to the end plate 35 and to the truss members 38 of a composite dual panel truss gives the lifting member 11 the strength for lifting a panel using the multiple slings 17 of the lifting beam 12.

The process of lifting a panel 10 or a dual panel composite truss having panels 10 and 36 includes selecting a flat concrete panel 10 to be lifted and having a plurality of steel reinforcing members 37 and 38 and an elongated steel end plate 35, such as a steel angle iron member. The selected panel 10 has a plurality of lifting members 11 fixedly attached to the end plate 35 and to at least one truss reinforcing member 38. A lifting assembly or beam 12 is selected having an elongated beam for lifting a generally flat concrete panel. The lifting beam 12 has lifting cables 15 and a plurality of shackles 16 having slings 17 having hoisting hooks 18 thereon. The lifting beam also has a plurality of wheels 25 and tilting cams 26 attached thereto. The lifting assembly 12 is then placed on a flat concrete panel surface and rolled on the wheels 25 to position the slings 17 and hoisting hooks 18 adjacent the lifting members 11 of the concrete panel 10. The hoisting hooks 18 are then attached to the lifting members 11 and the beam 12 tilted up on the cams 26 and the lifting beam 12 lifted by a winch or the like to lift the panel 10.

It should be clear at this time that a lifting assembly for lifting predetermined concrete panels having lifting eyes formed therein and a process of lifting a generally flat panel has been provided. However the present invention is not to be considered limited to the forms shown which are to be considered illustrative rather than restrictive.

We claim:

1. A lifting assembly for lifting concrete panels comprising:

an elongated lifting beam for lifting a generally flat concrete panel having a plurality of lifting eye members formed thereon;

a plurality of lifting cables attached to said lifting beam for lifting said lifting beam;

a plurality of shackles attached to said beam;

a plurality of lifting slings each having two ends and each having one end attached to one of said plurality of shackles, each said lifting sling having a hoisting hook on the other end thereof; and a plurality of wheel assemblies fixedly attached to said lifting beam, each wheel assembly having a beam tilting cam thereon;

whereby said lifting assembly can be rolled on a surface of said generally flat concrete panel to position said plurality of sling hoisting hooks for connection to said lifting eye members on said generally flat concrete panel for lifting said concrete panel.

2. The lifting assembly for lifting concrete panels in accordance with claim 1 in which said lifting beam is a an I-beam.

3. The lifting assembly for lifting concrete panels in accordance with claim 2 in which said I-beam is made of two C-beams.

4. The lifting assembly for lifting concrete panels in accordance with claim 1 in which each said shackle is connected to said lifting beam through a resilient pad thereby allowing each said shackle and attached sling to have some movement relative to said lifting beam.

5. The lifting assembly for lifting concrete panels in accordance with claim 4 in which said resilient pad is an elastomer pad.

6. The lifting assembly for lifting concrete panels in accordance with claim 1 in which said lifting beam has a pair of flanges thereon supporting a sling hook rod positioned to attach each said sling hook to hold said slings when positioning said sling assembly on a concrete panel.

7. The lifting assembly for lifting concrete panels in accordance with claim 5 in which each said wheel assembly has four wheels thereon.

8. The lifting assembly for lifting concrete panels in accordance with claim 7 having two lifting cables for lifting said lifting beam.

9. The lifting assembly for lifting concrete panels in accordance with claim 8 in which each said wheeled assembly is attached between said pair of C-beams of said lifting assembly.

* * * * *